US006234619B1

(12) United States Patent
Kiritake

(10) Patent No.: US 6,234,619 B1
(45) Date of Patent: May 22, 2001

(54) INK CARTRIDGE

(75) Inventor: Masayoshi Kiritake, Yokohama (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/549,320

(22) Filed: Apr. 13, 2000

(30) Foreign Application Priority Data

Apr. 20, 1999 (JP) ..... 11-112500

(51) Int. Cl.[7] ..... B41J 2/175
(52) U.S. Cl. ..... 347/87; 347/86
(58) Field of Search ..... 347/85, 86, 87, 347/93

(56) References Cited

FOREIGN PATENT DOCUMENTS 2-297498 12/1990 (JP) .
3-169562 7/1991 (JP) .
7-68780 3/1995 (JP) .
8-290585 11/1996 (JP) .
2683187 8/1997 (JP) .
2684508 8/1997 (JP) .

*Primary Examiner*—N. Le
*Assistant Examiner*—Anh T. N. Vo
(74) *Attorney, Agent, or Firm*—Darby & Darby

(57) ABSTRACT

An ink is stored directly in an ink storage chamber. An printing head connecting portion is arranged on the bottom side of the ink storage chamber and an ink collector is arranged on the bottom side of the ink storage chamber and alongside on the upper face of the printing head connecting portion. The ink collector is provided with a plurality of vertical plate-like blade portions arranged in parallel in the axial direction so as to form an ink collector spaces therebetween, and the blade portions are provided with communicating notches in a line so that these communicating notches form an air/ink moving groove extending in the axial direction. One end of the air/ink moving groove is communicated with an air intake, and the other end thereof is communicated with the ink storage chamber. The air/ink moving groove moves the ink or the air between the ink storage chamber and the ink collector spaces or the air intake, when the pressure in said ink storage chamber becomes too high or too low.

3 Claims, 1 Drawing Sheet

INK CARTRIDGE

BACKGROUND OF THE INVENTION (1) Field of the Invention

The present invention relates to an ink cartridge used for an ink jet printer (an ink jet recorder) which discharges an ink from a nozzle of a printing head, and lets it fly and adhere onto a paper or the like.

(2) Description of the Prior Art

An ink cartridge of an ink jet printer is provided with an ink storage chamber (ink tank) for storing the ink, and the ink storage chamber is communicated with an air moving passage such as an air intake or the like. The air moving passage is so constituted that it is closed by a surface tension (capillary force) of the ink, and when the pressure in the ink storage chamber becomes too low with the use (consumption) of the ink, outside air (atmospheric air) is introduced into the ink storage chamber via the air moving passage, to thereby increase the pressure in the ink storage chamber (Japanese Patent Publication No. 2683187, Japanese Patent Publication No. 2684508, Japanese Patent Application Laid-open Hei 2 No. 297498, Japanese Patent Application Laid-open Hei 7 No. 68780, Japanese Patent Application Laid-open Hei 3 No. 169562, Japanese Patent Application Laid-open Hei 8 No. 290585, etc.)

In addition, the ink cartridge is arranged with an ink collector adjacent to the ink storage chamber. The ink collector is constituted such that when the pressure in the ink storage chamber becomes too high due to the temperature increase or the like, the ink collector absorbs a part of the ink from the ink storage chamber and expands the air in the ink storage chamber, to thereby drop the pressure in the ink storage chamber. As the ink collector, there can be mentioned a structure in which an inks is absorbed in micropores in a massive porous body such as a sponge or the like (Japanese Patent Publication No. 2683187, Japanese Patent Publication No. 2684508 and Japanese Patent Application Laid-open Hei 7 No. 68780), and a structure in which an ink is absorbed in ink collector spaces between a plurality of lateral plate-like blade portions arranged in parallel in the vertical direction (top/bottom direction) (Japanese Patent Application Laid-open Hei 2 No. 297498, Japanese Patent Application Laid-open Hei 3 No. 169562, and Japanese Patent Application Laid-open Hei 8 No. 290585).

Moreover, in the case of the ink collector comprising a plurality of blades arranged in parallel in the vertical direction, the structure is such that the ink collector is disposed on the lower side of the ink storage chamber and on the upper side of the printing head, and an intermediary core (ink moving passage) comprising a bundle of fibers is provided penetrating through the blade portions of the ink collector in the vertical direction, thereby an ink is moved by a capillary force of the intermediary core from the ink storage chamber to the printing head side (Japanese Patent Application Laid-open Hei 8 No. 290585), or such that the ink collector is disposed on the lower side of the ink storage chamber and on the lower side of the printing head, and the ink is sucked up from the ink collector by a capillary force of the intermediary core (ink moving passage) (Japanese Patent Application Laid-open Hei 3 No. 169562).

Moreover, in the case of the ink collector comprising a plurality of blade portions arranged in parallel in the vertical direction, the structure is generally such that an ink moving passage (intermediary core, ink introducing groove) for moving the ink between the ink collector space between the blade portions and the ink storage chamber, and an air moving passage (air intake, ventilation passage) for moving the outside air in the ink storage chamber are separately formed (Japanese Patent Application Laid-open Hei 8 No. 290585 and Japanese Patent Application Laid-open Hei 3 No. 169562). Alternatively, the structure is such that an air pipe is connected via an ink inflow port of a container, and the air pipe is communicated with a capillary tank communicating with the air (Japanese Patent Application Laid-open Hei 2 No. 297498).

In the case of the massive porous body such as a sponge or the like, when being cut into a predetermined size, fine cutting wastes (foreign matter) are generated, and fine dust such as the cutting waste or the like may come into the micropores in the massive porous body, and it is difficult to clean and completely remove the fine dust intruded into the interior of the micropores in the massive porous body. Therefore, with an ink cartridge using the ink collector comprising the massive porous body, there is a possibility that fine dust is mixed into the ink from the massive porous body, and the printing head may be clogged with the fine dust.

Moreover, with the ink cartridge using the ink collector comprising the massive porous body, it is difficult to completely use (consume) the ink absorbed by the massive porous body, and only about 50 to 60% of the entire capacity of the ink can be used. Therefore, it is necessary to make the volume of the ink storage chamber larger than the ink volume expected to be used, and thus the ink cartridge becomes large, making it necessary to increase the space for mounting the ink cartridge to the ink jet printer.

Furthermore, with the ink cartridge in which the ink collector comprising a plurality of blade portions arranged in parallel in the vertical direction is disposed on the upper side of the printing head and the ink is moved from the ink storage chamber to the printing head side by means of the intermediary core, since the movement of the ink is performed by a capillary force of the intermediary core, the moving speed of the ink toward the printing head side is slow, and cannot cope with high speed printing. Moreover, with the ink cartridge in which the ink collector comprising a plurality of blade portions arranged in parallel in the longitudinal direction is disposed on the lower side of the printing head, and the ink moving passage and the air moving passage are formed separately, it is difficult to completely suck the ink up from the ink collector to the printing head side. In addition, the technique disclosed in Japanese Patent Application Laid-open Hei 2 No. 297498 is mainly related to a writing instrument, and the construction thereof is different from the other techniques described above as a matter of course.

SUMMARY OF THE INVENTION

The present invention has been completed under this background, and it is an object of the present invention to provide an ink cartridge which can prevent dust, air or the like from being supplied to the printing head, can use up the ink without wasting, and can suitably cope with high speed printing.

A first gist of the present invention resides in an ink cartridge used for an ink jet printer in which an ink is discharged from a nozzle of a printing head and made to fly and adhere onto a paper or the like, comprising:

an ink storage chamber for storing the ink directly;

a printing head connecting portion disposed on the bottom side of the ink storage chamber; and an ink collector disposed on the bottom side of the ink storage chamber and alongside on the upper face of the printing head connecting portion;

the ink collector being provided with a plurality of vertical plate-like blade portions arranged in parallel in the horizontal direction so as to form an ink collector spaces therebetween;

the blade portions being provided with communicating notches in a line for communicating adjoining the ink collector spaces so that these communicating notches form an air/ink moving groove extending in the lateral direction; and one end of the air/ink moving groove being communicated with an air intake, and the other end of the air/ink moving groove being communicated with the ink storage chamber;

wherein the air/ink moving groove moves the ink from the ink storage chamber to the ink collector spaces, when the pressure in the ink storage chamber becomes too high; and the air/ink moving groove moves the ink from the ink collector spaces to the ink storage chamber, when the pressure in the ink storage chamber becomes too low, or moves the air from the air intake to the ink storage chamber.

A second gist of the present invention resides in an ink cartridge according to the gist one, wherein a lateral plate-like flow resisting member is provided between the ink storage chamber and the printing head connecting portion; and the flow resisting member inhibits the ink from moving from the ink storage chamber to the printing head connecting portion, when the pressure in the ink storage chamber becomes too high.

A third gist of the present invention resides in an ink cartridge according to the gist two, wherein the flow resisting member inhibits dust and air from moving from the ink storage chamber to the printing head connecting portion.

According to the invention of the gist one, since the ink is directly stored in the ink storage chamber without being absorbed in the massive porous body such as a sponge or the like, it can be prevented that fine dust is mixed in the ink from the massive porous body to clog the printing head, and all of the ink stored in the ink storage chamber can effectively be used up. Moreover, since the printing head connecting portion is disposed on the bottom side of the ink storage chamber, the ink moving speed from the ink storage chamber to the printing head side can be increased, compared to the case where an intermediary core comprising a bundle of fibers is disposed between the ink storage chamber and the printing head connecting portion, thereby enabling to cope with high speed printing speed.

Furthermore, since the ink collector comprising a plurality of blade portions arranged in parallel in the lateral direction is provided, not the massive porous body such as a sponge or the like, it can be prevented that the printing head is clogged due to fine dust mixed in the ink from the massive porous body. Meanwhile, the ink collector is disposed alongside on the upper face of the printing head connecting portion, and the air/ink moving groove for moving the ink or the air when the pressure in the ink storage chamber becomes too high or too low is provided extending in the lateral direction, hence the pressure in the ink storage chamber can be maintained appropriately within a predetermined range, and the ink stored in the ink collector can effectively be used up.

With the invention according to the gist two, the lateral plate-like flow resisting member is provided between the ink storage chamber and the printing head connecting portion, and the flow resisting member inhibits the ink from moving from the ink storage chamber to the printing head connecting portion, when the pressure in the ink storage chamber becomes too high. According to the invention of the gist two, when the pressure in the ink storage chamber becomes too high, movement of the ink from the ink storage chamber to the printing head connecting portion is inhibited by the flow resisting member, hence it can be prevented that the ink is discharged excessively from the printing head (blotting).

With the invention according to the gist three, the flow resisting member prevents dust and air from moving from the ink storage chamber to the printing head connecting portion. According to the invention of the gist three, when dust is mixed in the ink in the ink storage chamber, movement of the dust from the ink storage chamber to the printing head connecting portion is inhibited by the flow resisting member, hence it can be prevented that the printing head is clogged due to the dust. Moreover, when the ink cartridge is inverted, since the movement of the air from the ink storage chamber to the printing head connecting portion is inhibited by the flow resisting member, it can be prevented that the intermediary core of the ink to the printing head is interrupted.

DESCRIPTION OF THE PREFERRED EMBODIMENTS

Figure 1:
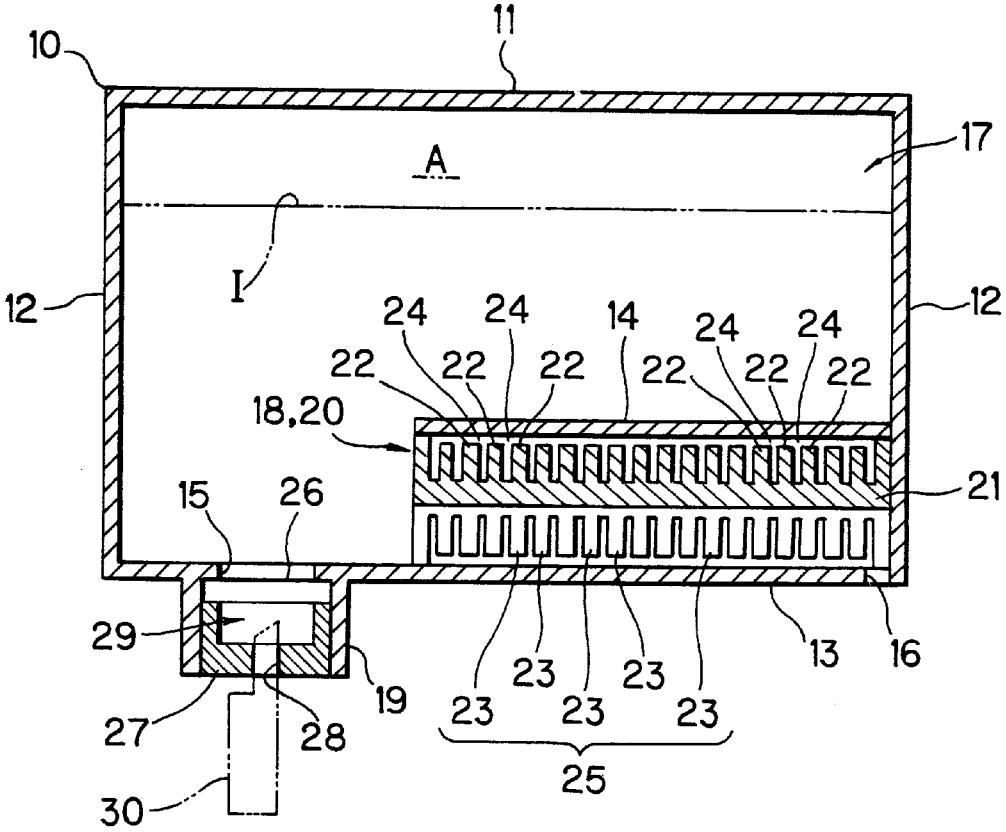
FIG. 1 is a longitudinal sectional view of an ink cartridge according to an embodiment of the present invention.
Figure 2:
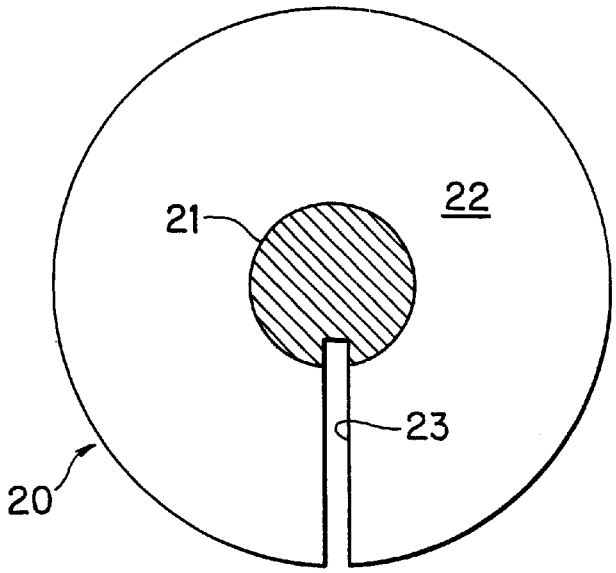
FIG. 2 is a lateral sectional view of an ink collector in FIG. 1.

As follows is a description of an embodiment of the present invention with reference to the accompanying drawings. FIG. 1 is a longitudinal sectional view of an ink cartridge according to an embodiment of the present invention, and FIG. 2 is a lateral sectional view of an ink collector in FIG. 1.

As shown in FIG. 1, a main body portion 10 formed in a hollow box shape by a horizontal plate-like top plate portion 11, a vertical plate-like side plate portions 12, and a lateral plate-like bottom plate portion 13 is provided in the ink cartridge according to the embodiment of the present invention. In a position deviated alongside of the bottom plate portion 13, is provided an ink discharge port 15, penetrating through the bottom plate portion 13 in the vertical direction (top/bottom direction). Moreover, the ink cartridge is provided with a printing head connecting portion 19 having a cylindrical shape in the vertical direction with the lower end being opened, in a form of enclosing the outer circumference of the ink discharge port 15, integrally with the main body portion 10, and protruding from the bottom plate portion 13 downward.

A partition plate portion 14 in a cylindrical shape in the horizontal direction is provided in the inner space of the main body portion 10, protruding from the side plate portion 12 on the opposite side of the ink discharge port 15 horizontally inside, and the inner space of the main body portion 10 is divided into an ink storage chamber 17 and an ink collector chamber 18 by the partition plate portion 14. The ink collector chamber 18 is formed in an oblong shape between the bottom plate portion 13 and the partition plate portion 14, and the outer end of the ink collector chamber 18 is closed by the side plate portion 12 and the inner end of the ink collector chamber 18 (on the ink storage chamber 17 side) is opened. The bottom plate portion 13 is provided with an air intake 16 at a position on the lower side of the outer end of the ink collector chamber 18, penetrating through in the vertical direction.

In the inside of the ink collector chamber 18, an ink collector 20 in an oblong columnar form is mounted with the inner opening end being closed. The ink collector 20 is an integrally injection-molded article, made of a synthetic resin, and has such a structure that a multiplicity of vertical plate-like blade portions 22 are coupled in the horizontal direction (axial direction) by means of a shaft portion 21 in an oblong rod shape, and between the blade portions 22, 22, ink collector spaces 24 are formed at a predetermined interval. Moreover, as shown in FIG. 2, a vertical communicating notch 23 is provided penetrating through in the horizontal direction (axial direction) on the lower side portion of each blade portion 22. As shown in FIG. 1, the communicating notches 23 of respective blade portions 22 are aligned in the horizontal direction (axial direction), and an air moving groove 25 extending in the axial direction is formed by these communicating notches 23. The ink collector space 24 and the ink moving groove 25 are formed so that the capillary force of the ink moving groove 25 becomes larger than the capillary force of the ink collector space 24. One end of the air/ink moving groove 25 in the ink collector 20 is communicated with the air intake 16, and the other end of the air/ink moving groove 25 is communicated with the ink storage chamber 17.

Moreover, on the upper side on the inner circumference of the printing head connecting portion 19 (right under the ink discharge port 15), there is mounted a lateral plate-like flow resisting member 26 serving also as a filter, and the flow resisting member 26 is constituted so as to let the ink pass through from the upper face side to the lower face side at a predetermined flow resistance. Also on the lower side on the inner circumference of the printing head connecting portion 19 (under the flow resisting member 26), there is mounted a cup-shaped rubber bush 27 with the upper end being opened. On the inner circumference of the rubber bush 27, there is formed an ink discharge chamber 29 having a predetermined volume. On the bottom portion of the rubber bush 27, there is provided a head fit-in hole 28 penetrating through in the vertical direction, in which the upper end portion of the printing head 30 is fitted.

As for the flow resisting member 26, a porous body such as urethane foam or the like can be used. The porous body in this case, however, is not a relatively large mass as in the conventional ink collector, and a relatively thin plate-like porous body is used. Therefore, fine dust or the like attached to the plate-like porous body can be reliably removed by cleaning. Also as the flow resisting member 26, a metal plate (aluminum plate, stainless steel plate or the like) having fine ink passage holes may be used. In addition, the flow resisting member 26 is formed so that the capillary force thereof becomes larger than that of the air/ink moving groove 25 in the ink collector 20.

With the ink cartridge constituted as described above, when the ink I is discharged from the printing head 30, the ink I moves from the ink discharge chamber 29 to the printing head 30, as well as the ink I moves from the ink storage chamber 17 to the ink discharge chamber 29 via the flow resisting member 26. Therefore, the movement of the ink I from the ink storage chamber 17 to the printing head 30 side is performed at a relatively high speed, such that the ink I directly stored in the ink storage chamber 17 and the ink discharge chamber 29 is moved, not by a method in which the ink is moved via an intermediary core comprising a bundle of fibers, hence a large amount of the ink I can be fed to the printing head 30 uninterrupted, corresponding to increase of the printing speed.

If the pressure (negative pressure) in the ink storage chamber 17 becomes too low due to the use (consumption) of the ink I, outside air A (atmospheric air) is taken into the ink storage chamber 17 from the air intake 16 via the air/ink moving groove 25 in the ink collector 20, so that the pressure in the ink storage chamber 17 increases. Also when the pressure in the ink storage chamber 17 becomes too high due to the increase of the temperature or the like, a part of the ink I in the ink storage chamber 17 moves to the ink collector spaces 24 via the air/ink moving groove 25 in the ink collector 20, and the pressure decreases due to the expansion of the air A in the ink storage chamber 17. When the pressure in the ink storage chamber 17 becomes too low again due to the drop of the temperature or the use of the ink I, the ink I in the ink collector spaces 24 in the ink collector 20 moves to the ink storage chamber 17 via the air/ink moving groove 25, to thereby increase the pressure in the ink storage chamber 17.

Accordingly, the pressure in the ink storage chamber 17 is maintained within a predetermined range, it can be appropriately prevented that the feed of the ink I to the printing head 30 is interrupted due to the too low pressure in the ink storage chamber 17, or that the ink I is excessively discharged from the printing head 30 (blotting) due to the too high pressure in the ink storage chamber 17. In addition, it is preferable that the pressure in the ink storage chamber 17 be adjusted so that the pressure in the ink discharge chamber 29 (supply pressure of the ink I to the printing head 30) becomes a negative pressure of from about −30 to about −100 mmAq (water head).

Moreover, the ink I is directly stored in the ink storage chamber 17, and since the ink is not absorbed by a massive porous body such as a sponge or the like, it can be prevented that fine dust is mixed in the ink I in the ink storage chamber 17 from the massive porous body. Also, since the flow resisting member 26 serving also as a filter is mounted to the ink discharge port 15, even if dust is mixed in the ink I in the ink storage chamber 17, the dust is prevented from moving toward the printing head 30 side, to thereby prevent the printing head 30 from being clogged by the dust.

Also, the ink I is directly stored in the ink storage chamber 17, and since the ink is not absorbed by a massive porous body such as a sponge or the like, the ink I in the ink storage chamber 17 can be used up (consumed), without remaining the unused ink, hence the volume of the ink storage chamber 17 can be miniaturized and the ink cartridge can be also made small. In addition, since the ink collector 20 is arranged in the horizontal direction at the upper position than the printing head connecting portion 19, the ink I temporarily stored in the ink collector 20 can be easily returned to the ink storage chamber 17, thus enabling to use (consume) the ink I without wasting.

Moreover, since the ink I is directly stored in the ink storage chamber 17 (without being absorbed in a sponge or the like), the air A taken into the ink storage chamber 17 via the ink collector 20 moves smoothly upward (in the direction opposite to the ink discharge port 15), and it can be prevented that the air bubbles come into the printing head 30 side to cause a printing problem. In addition, since the flow resisting member 26 is provided in the ink discharge port 15, when the pressure in the ink storage chamber 17 becomes too high, the ink I in the ink storage chamber 17 can be smoothly moved to the ink collector 20.

Furthermore, when the ink cartridge is inverted, the air A in the ink storage chamber 17 moves to the ink discharge port 15 side, but since the flow resisting member 26 is provided in the ink discharge port 15, the air A in the ink storage chamber 17 can be prevented from intruding into the ink discharge chamber 29. When the ink cartridge is in upright position again, the ink I can be supplied smoothly to the printing head 30 from the ink storage chamber 17 via the flow resisting member 26 and the ink discharge chamber 29.

In the embodiment described above, there has been described a case where the ink collector comprising a plurality of blade portions arranged in parallel in the vertical direction is an integrally injection-molded article made of a synthetic resin, but the ink collector may have such a construction that each blade and shaft portion are separately formed and these portions are assembled together.

According to the invention of the gist one, since the ink is directly stored in the ink storage chamber without being absorbed in a massive porous body such as a sponge or the like, it can be prevented that fine dust is mixed in the ink from the massive porous body to thereby clog the printing head, and the ink stored in the ink storage chamber can be completely used up, without remaining the unused ink. Also, since the printing head connecting portion is arranged at the bottom of the ink storage chamber, the ink moving speed from the ink storage chamber to the printing head side can be speeded up, compared to the case where an intermediary core comprising a bundle of fibers is provided between the ink storage chamber and the printing head connecting portion, thereby enabling to easily correspond to increase of the printing speed.

Moreover, since the ink collector comprising a plurality of blade portions arranged in parallel in the vertical direction, not amassive porous body such as a sponge or the like is provided, it can be prevented that fine dust is mixed in the ink from the massive porous body to thereby clog the printing head. In addition, since the ink collector is arranged alongside on the upper face of the printing head connecting portion, and the air/ink moving groove is provided extending in the horizontal direction, which moves the ink and the air when the pressure in the ink storage chamber becomes too high or too low, the pressure in the ink storage chamber can be appropriately maintained within a predetermined range, and the ink stored in the ink collector can be used up without wasting.

Moreover, according to the invention of the gist two, when the pressure in the ink storage chamber becomes too high, the movement of the ink from the ink storage chamber to the printing head connecting portion is inhibited by the flow resisting member, hence it can be prevented that the ink is excessively discharged (blotting) from the printing head.

Furthermore, according to the invention of the gist three, when dust is mixed in the ink in the ink storage chamber, movement of the dust from the ink storage chamber to the printing head connecting portion is inhibited by the flow resisting member, hence it can be prevented that the printing head is clogged due to the dust. In addition, if the ink cartridge is inverted, since the movement of the air from the ink storage chamber to the printing head connecting portion is inhibited by the flow resisting member, it can be prevented that the supply of the ink to the printing head is interrupted.

What is claimed is:

1. An ink cartridge used for an ink jet printer in which an ink is discharged from a nozzle of a printing head and made to fly and adhere onto a paper, comprising:

an ink storage chamber for storing the ink directly;

a printing head connecting portion disposed on a bottom side of said ink storage chamber for receiving the printer head; and an ink collector disposed on the bottom side of said ink storage chamber and alongside on an upper face of said printing head connecting portion, said ink collector being disposed in a horizontal direction;

said ink collector being provided with a plurality of vertical plate-like blade portions arranged in parallel in the horizontal direction so as to form ink collector spaced therebetween;

said blade portions being provided with communicating notches in a line for communicating adjoining said ink collector spaces so that the communicating notches form an air/ink moving groove extending in a lateral direction; and one end of said air/ink moving groove being communicated with an air intake, and other end of said air/ink moving groove being communicated with said ink storage chamber;

wherein said air/ink moving groove moves the ink from said ink storage chamber to said ink collector spaces, when a pressure in said ink storage chamber becomes too high; and said air/ink moving groove moves the ink from said ink collector spaces to said ink storage chamber, when the pressure in said ink storage chamber becomes too low, or moves air from said air intake to said ink storage chamber.

2. An ink cartridge according to claim 1, wherein a lateral plate-like flow resisting member is provided between said ink storage chamber and said printing head connecting portion; and said flow resisting member inhibits the ink from moving from said ink storage chamber to said printing head connecting portion, when the pressure in said ink storage chamber becomes too high.

3. An ink cartridge according to claim 2, wherein the flow resisting member inhibits dust and air from moving from said ink storage chamber to said printing head connecting portion.

* * * * *